US009808083B2

(12) United States Patent
Lucas

(10) Patent No.: US 9,808,083 B2
(45) Date of Patent: Nov. 7, 2017

(54) DEVICE FOR RELEASABLY CONNECTING A FURNITURE DRAWER TO A GUIDANCE UNIT THAT MOVEABLY GUIDES THE DRAWER IN A FURNITURE BODY

(71) Applicant: Grass GmbH, Höchst (AT)

(72) Inventor: Tim Lucas, Leinfelden-Echterdingen (DE)

(73) Assignee: Grass GmbH, Höchst (AT)

( * ) Notice: Subject to any disclaimer, the term of this patent is extended or adjusted under 35 U.S.C. 154(b) by 0 days.

(21) Appl. No.: 15/285,998

(22) Filed: Oct. 5, 2016

(65) Prior Publication Data

US 2017/0095081 A1 Apr. 6, 2017

(30) Foreign Application Priority Data

Oct. 5, 2015 (DE) ..... 20 2015 006 933 U

(51) Int. Cl.
*A47B 88/00* (2017.01)
*A47B 88/04* (2006.01)

(52) U.S. Cl.
CPC .. *A47B 88/0422* (2013.01); *A47B 2088/0437* (2013.01)

(58) Field of Classification Search
CPC ..... A47B 88/0422; A47B 2088/0437
USPC ..... 312/334.4
See application file for complete search history.

(56) References Cited

U.S. PATENT DOCUMENTS 4,291,929 A * 9/1981 Faust ..... A47B 88/044 312/311
5,439,283 A * 8/1995 Schroder ..... A47B 88/0407 312/334.38
2012/0311818 A1* 12/2012 Grabher ..... A47B 88/0055 16/82
2013/0113356 A1* 5/2013 Salice ..... A47B 88/0422 312/334.44
2013/0257244 A1* 10/2013 Salice ..... A47B 88/0422 312/319.1
2013/0293077 A1* 11/2013 Haemmerle ..... A47B 88/0422 312/319.1
2013/0293078 A1* 11/2013 Haemmerle ..... A47B 88/0466 312/333
2014/0015392 A1* 1/2014 Salice ..... A47B 88/0422 312/334.44
2014/0175965 A1* 6/2014 Salice ..... A47B 88/0422 312/334.1
2014/0314347 A1* 10/2014 Huang ..... A47B 88/0407 384/22
2016/0128476 A1* 5/2016 Ng ..... A47B 88/16 312/333

* cited by examiner

*Primary Examiner* — Hanh V Tran
(74) *Attorney, Agent, or Firm* — Edell, Shapiro & Finnan LLC

(57) ABSTRACT

A device for releasably connecting a furniture pull-out to a guidance unit that movably guides the furniture pull-out in a furniture body comprises: a base part; an adjuster arranged on the base part and comprising a plurality of components movable in relation to one another, the adjuster enabling a position of the furniture pull-out to be set in at least one spatial direction relative to the guidance unit; and a stop mechanism to delimit the travel of the adjuster, the stop mechanism including a springy-elastic component.

7 Claims, 4 Drawing Sheets

DEVICE FOR RELEASABLY CONNECTING A FURNITURE DRAWER TO A GUIDANCE UNIT THAT MOVEABLY GUIDES THE DRAWER IN A FURNITURE BODY

CROSS REFERENCE TO RELATED APPLICATIONS

This application claims foreign priority under 35 U.S.C. §119(a)-(d) to German Patent Application No. DE 202015006933.9 filed on Oct. 5, 2015, the entire contents of which are hereby incorporated by reference.

FIELD OF THE INVENTION

The invention relates to a device for releasably connecting a furniture pull-out such as a drawer to a guidance unit that movably guides the drawer in a furniture body. The device includes a base part, on which an adjuster, belonging to the device and comprising a plurality of components movable in relation to one another, is arranged, via which a position of the furniture pull-out connected to the guidance unit relative to the guidance unit in at least one spatial direction with respect to the guidance unit can be set, and wherein a stop mechanism is provided, which delimits a travel of the adjuster.

BACKGROUND

A device of this type is known, by way of example from EP 0 695 523 B1 or alternatively from DE 20 2011 104 673. Such devices are used for coupling the guidance unit with a furniture pull-out, so that the furniture pull-out, by way of example a drawer, can if necessary be separated from the guidance unit.

Thus it can be removed by itself from the furniture body, whereby it is possible for the guidance unit to be mounted permanently in the body.

Such devices serve, in addition to the coupling of the furniture pull-out and the guidance unit, for adjusting the position of the furniture pull-out in relation to the guidance unit. This is important, in order to set at the front of the furniture pull-out in its closed position an even joint arrangement or an even gap width between the edges of the front of the furniture pull-out and the surrounding furniture body. To this end, it is possible to adjust the height or also the lateral positioning of the furniture pull-out via the device. A tilt or depth adjustment of the furniture pull-out with respect to the guidance unit is also conceivable.

It is possible to equip the device or coupling with an adjuster, which allows only an adjustment in one of the spatial directions, or alternatively to fit it with an adjuster that allows adjustment in a plurality of spatial directions, for example two or three.

There is also a need to delimit the travel of the adjuster, so that during adjustment the components of the adjuster do not come apart.

SUMMARY

The object of the invention is to provide a device of the abovementioned type, which compared with conventional devices is more functionally reliable in use, in particular it is intended in this way to prevent the components of the adjuster coming apart during adjustment.

This object is achieved by a device for releasably connecting a furniture pull-out to a guidance unit that movably guides the furniture pull-out in a furniture body.

The device according to the invention is characterized in that the stop mechanism has a springy-elastic design.

The stop mechanism is intended to delimit the travel of the furniture pull-out in relation to the guidance unit. It is necessary that between a component of the adjuster unit and a component of the base part, one of the stops for delimiting the travel is struck in order to prevent the components of the adjuster device coming apart during adjustment. As a result of the springy elasticity of the stop mechanism on sides of the adjuster, these can move into a position that allows easy assembly/disassembly of the adjuster on the base part of the device. Following mounting of the adjuster on the base part, the stop mechanism then adopts a position in which during it strikes a component of the base part to delimit the travel.

In a further development of the invention the stop mechanism comprises at least one springy-elastic, in particular bolt-like, stop element and a stop recess limiting the travel of the adjuster with its faces, for holding the stop element. The bolt-like stop element could also be referred to as a locking bolt. To delimit the travel of the adjuster the stop element strikes at least one of the faces of the stop recess.

In a particularly preferred manner, the springy-elastic stop element is formed so that between an engaged position in engagement with the stop recess and a released position for assembly/disassembly the adjuster can be moved away from the base part, wherein the release position can be reached by working against a springy-elastic restoring force of the stop element. It is therefore possible to press the stop element down onto the base part during assembly, so that upon reaching the intended assembled state the adjuster can click into the stop recess.

It is possible for the stop element to be arranged on the adjuster and the stop recess on the base part. Alternatively, however, it is conceivable to arrange the stop recess on the adjuster and the springy-elastic stop element on the base part.

In a further development of the invention the adjuster has a side adjuster unit for setting the position of the furniture pull-out relative to the guidance unit transversally to a longitudinal direction of the guidance unit, wherein the components of the side adjuster unit comprise an adjusting element and a coupling element movable relative to the adjusting element, that is or can be coupled to the guidance unit, for lateral adjustment of the furniture pull-out with respect to the guidance unit.

The adjuster can additionally or alternatively have a height adjuster unit for setting the position of the furniture pull-out in the vertical direction to the guidance unit.

It is possible that the adjusting element is designed as an adjusting wheel and the coupling element has a base section for coupling with an associated section of the guidance unit and a threaded shaft onto which the adjusting wheel is screwed.

In a further development of the invention, the springy elastic stop element is formed on the base section of the coupling element and the stop recess on the base part.

In a further development of the invention, an anti-lift device is provided to prevent lifting of the adjuster in the direction vertically to the operating surface. The anti-lift device can be formed by a component of the base part. Advantageously, the base part has a support section having a recess, in which the coupling element is held. Here the recess can be delimited by sides of the support section, which extend beyond the top of the coupling element, thereby preventing any lifting.

The invention further comprises a piece of furniture, with a furniture pull-out, which is movably guided relative to a furniture body via a guidance unit, wherein the piece of furniture is characterized by the aforementioned device.

BRIEF DESCRIPTION OF THE DRAWINGS

An example embodiment of the invention is shown in the drawing and is explained in the following. The drawing shows as follows.

DETAILED DESCRIPTION

Figure 1:
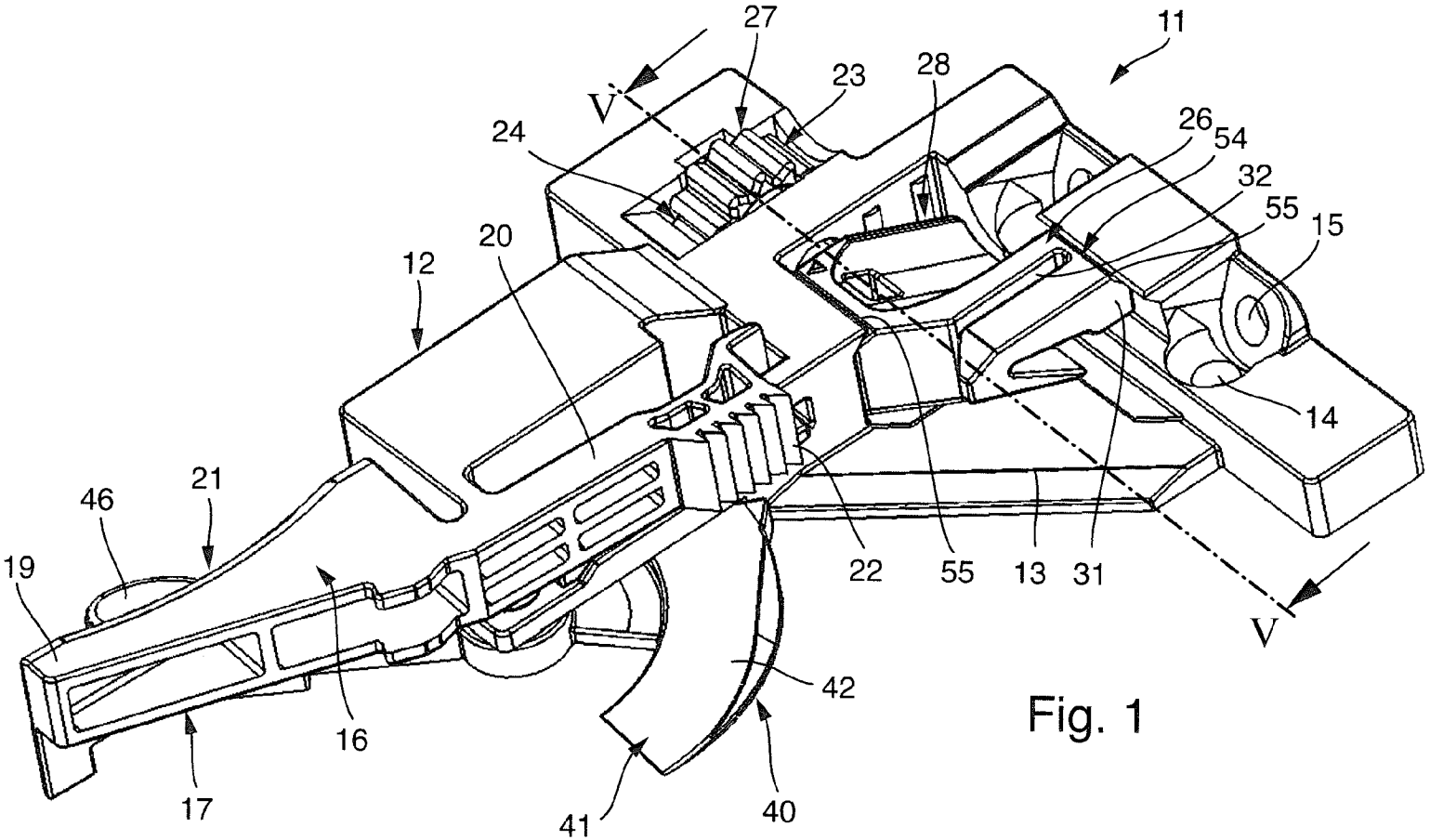
FIG. 1 is a perspective view of an embodiment of the device according to the invention.

FIGS. 1-5 show an example embodiment of the device 11 according to the invention, which serves for releasably connecting a furniture pull-out, which is movably guided in a furniture body via a guidance unit (not shown), to the guidance unit.

The device 11 is in the following, as an example case, illustrated as a furniture pull-out configured as a drawer.

The drawer is movably supported via the at least one guidance unit relative to the furniture body. Advantageously, a plurality of guidance units is provided, of which two are associated with opposing sides of the drawer. The guidance units can be components of what is known as an underfloor guidance, in which the guidance units are associated with the drawer bottom. An alternative possibility would be to incorporate the guidance units in the side wall or frame of the drawer. The device according to the invention 11 serves as a connecting element between the guidance unit and the drawer. The device 11 could therefore also be referred to as a coupling.

The device 11 has a housing-like base part 12, comprising plastic and is advantageously manufactured by injection molding. The base part 12 has a baseplate 13 with guiding holes 14 for securing to the floor of a drawer via suitable fastening elements, for example screws. The front of the baseplate 13 is broader than the rest of the baseplate 13, wherein on the front substantially perpendicular to the baseplate 13, through-holes 15 are provided, by which a securing to a side wall protruding downwards beyond the floor or on the front, in particular front panel, of the drawer is possible. A support section 16 with an elongated form rises up over the baseplate 13 of the base part 12.

A further component of the device 11 is a lever-like adjusting element 17, by which at least one flexure bearing 18 is formed on the support section 16 of the base part 12. The adjusting element 17 similarly comprises plastic and is injection molded onto the base part 12 at the same time that this is manufactured. Advantageously, the adjusting element 17 is made from the same plastic material, whereby the production costs are low because it can be made by single-component injection molding.

The adjusting element 17 is supported so that it can swivel via the flexure bearing 18 on the support section 16. The adjusting element 17 has an operating section 19 that can be manually operated, having a handle design. The operating section 19 is positioned on one side of the flexure bearing 18, wherein on the other side an engagement section 20 is provided, which is provided to engage in complementary engagement mechanism (not shown) on the guidance unit.

As shown in particular in FIG. 1, the handle-like operating section 19 has a wedge-like design, wherein on the outside of the operating section 19 and if necessary curved operating surface 21 is provided, for gripping via the fingers of the user. On the other side of the flexure bearing 18, the engagement section 20 is provided with a catch mechanism in the form of catch teeth 22. The catch teeth 22 on the engagement section are, in the mounted state of the device 11, latched with complementary catch teeth, not shown, on the guidance unit, whereby the drawer is coupled to the guidance unit. Through pressure applied by the finger of the user to the operating surface 21 the adjusting element is able to swivel in the clockwise direction about the flexure bearing 18, wherein the engagement section with the catch teeth 22 swivels in the direction of the support section 16 of the base part 12, whereby catch teeth 22 on the adjusting element 17 unlatch from the complementary catch teeth on the guidance unit.

The device 11 also has an adjuster 23, comprising a plurality of components movable in relation to one another. The adjuster enables a position of the drawer connected to the guidance unit relative to the guidance unit in at least one spatial direction with respect to the guidance unit to be set.

As shown in particular in FIG. 1, the device 11 is configured as what is known as a 2D-coupling.

In the example case shown, the adjuster 23 comprises a side adjuster unit 26 for setting the position of the drawer relative to the guidance unit transversally to a longitudinal direction of the guidance unit.

Figure 3:
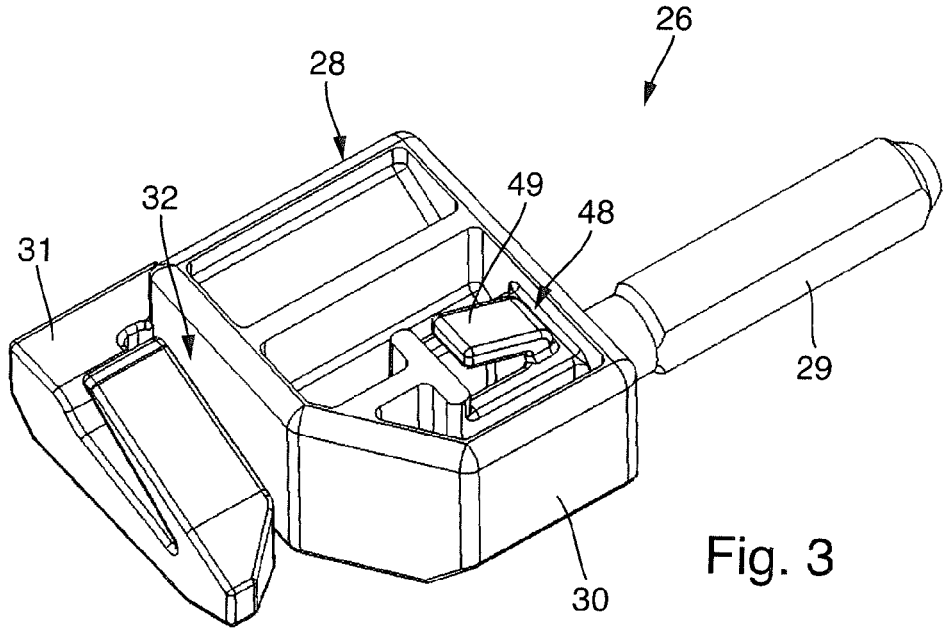
FIG. 3 is a perspective view of an embodiment of a subassembly of the adjuster for the device according to the invention.
Figure 4:
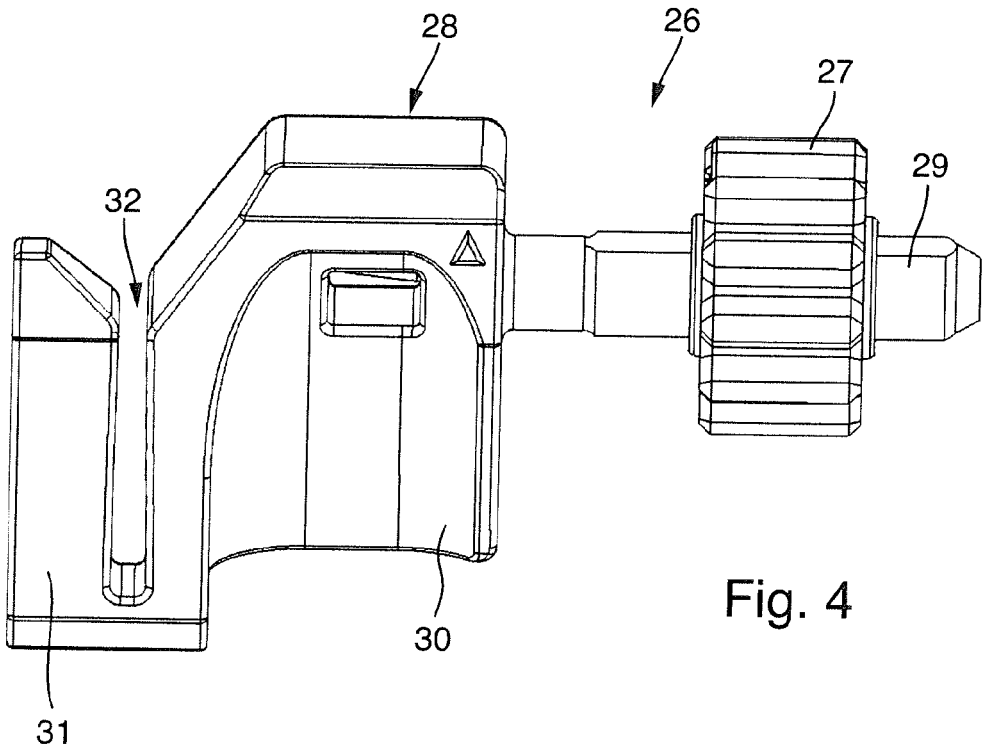
FIG. 4 is a side view of the subassembly from FIG. 3.

As in particular shown in FIG. 3, the components of the side adjuster unit 26 comprise an adjusting element 27 and a coupling element 28 movable relative to the adjusting element 27, that is or can be coupled to the guidance unit, for lateral adjustment of the furniture pull-out with respect to the guidance unit.

As further shown in FIG. 3, the adjusting element 27 is in the form of an adjusting wheel. The coupling element 28 has a threaded shaft 29, onto which the adjusting wheel is screwed.

As shown in particular in FIG. 3, the coupling element 28 also has, apart from the threaded shaft 29, a base section 30, from one side of which the threaded shaft 29 extends and on the other a wedge-shaped coupling section 31 is attached.

The coupling element and the adjusting wheel screwed onto it are, like the base part 12, plastic injection-molded parts.

The base section 30 of the coupling element 28 can be configured as a hollow body, which in the example case shown is reinforced by ribs extending in the longitudinal direction of the threaded shaft 29. This results in a saving in materials when manufacturing the coupling element 28.

As in particular shown in FIG. 1, the wedge-shaped coupling section 31 has a holding slot 32 extending transversally, in particular, vertically to the longitudinal axis of the threaded shaft 29. The holding slot 32 serves to hold a holding section of the guidance unit, in particular of a wall section of a sliding or drawer rail of the guidance unit.

In the intended assembled state, the adjusting wheel is held in a holding receptacle 24 with an in particular rectangular design, which is open both to the mounting side 33 and to the operating side. The holding receptacle 24 has two opposing longitudinal walls 60*a*, 60*b*, which are upstream in the direction of one of the faces of the adjusting wheel and upstream in the opposite direction of the other. The adjusting wheel cannot therefore move in the longitudinal direction of the threaded shaft.

Figure 5:
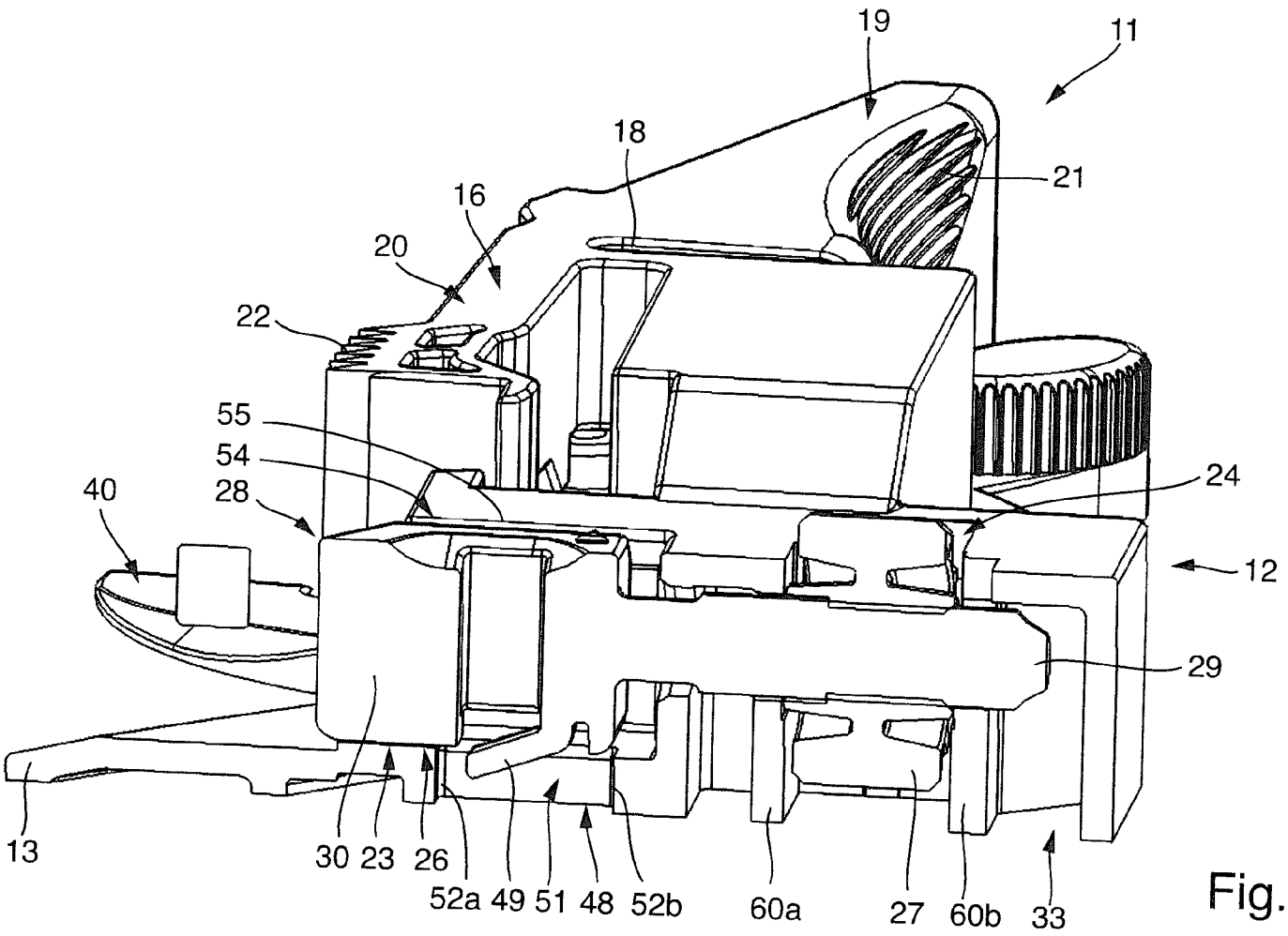
FIG. 5 is a longitudinal cross-section through the subassembly along the line V-V of FIG. 1.

As in particular shown in FIG. 5, the threaded shaft 29 penetrates the two end walls 60*a*, 60*b*, and thus prevents the adjusting wheel from lifting in the vertical direction As in particular shown in FIG. 1, the adjuster also has a height adjuster unit 40 for setting the position of the drawer relative to the guidance unit in the vertical direction. The height adjuster unit 40 has, as shown in particular in FIGS. 1 and 2, a wedge-shaped, more or less semi-circular ramp 41, supported on the mounting side 33 of the base part 12, in the region of the support section 16, so that it can pivot about a pivot axis 42. The effective wedge surface 42 of the ramp 41 engages in the gap between the top of the drawer rail or slide rail and the drawer floor. The ramp 41 can be adjusted via a handle 46 extending radially outwards located on the ramp 41, whereby optionally a larger or smaller section of the wedge surface 42 in the vertical direction protrudes into the gap and thus leads to an increase or a decrease in the distance between the drawer floor and the slide rail, allowing the drawer to be set in the vertical direction.

Figure 2:
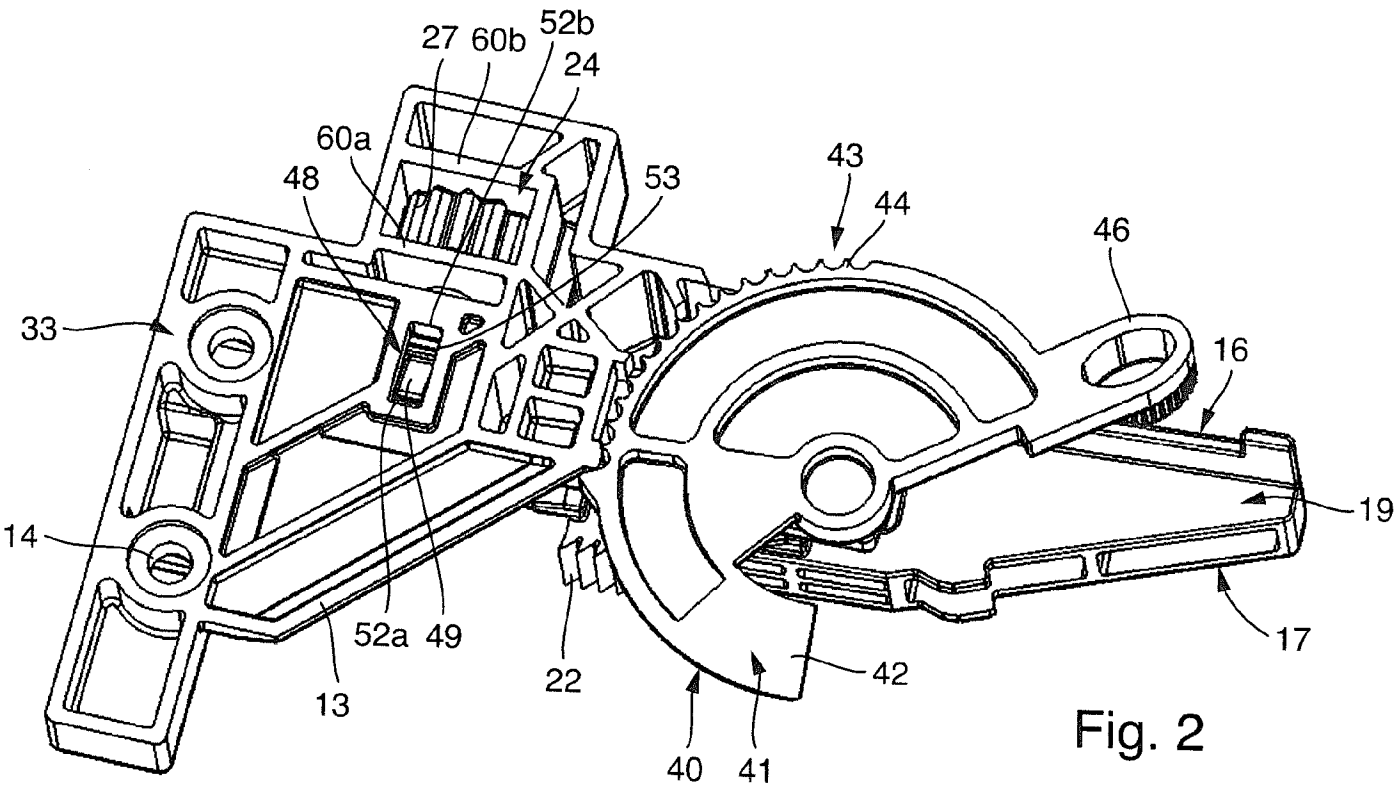
FIG. 2 is a top view of the assembly side of the device from FIG. 1.

As in particular shown in FIG. 2, on the outer circumference of the semi-circular ramp 41, a detent 43 is provided, with a number of catch teeth 44, which interact with projections formed on the baseplate 13. In this way, it is possible to fix the set position of the height adjuster unit 40.

As can be seen in particular in FIG. 5, the device comprises stop mechanism 48 with a springy-elastic design. The stop mechanism 48 serves to delimit the travel of the adjuster 23. This is intended to prevent the adjusting wheel being turned too far and the threaded shaft 29 disengaging from the adjusting wheel. Should this happen, the adjusting wheel would drop out of the holding receptacle 24.

The stop mechanism 48 comprises a springy-elastic stop element 49 which, as in particular shown in FIG. 5, protrudes from the underside of the base section 30 of the coupling element 28 diagonally downwards. The springy-elastic stop element 49 could also be referred to as a locking bolt. The stop mechanism 48 further comprises a stop recess 51 formed in the baseplate 13 of the base part 12, into which the stop element 49 protrudes. The stop recess 51 has two faces 52*a*, 52*b* arranged opposite one another and projecting into the travel of the stop element 49 or base section 30 of the coupling element 28.

As in particular shown in FIG. 2, the support section 16 of the base part 12 has a recess 53, in which the coupling element, thus the base section 30 and the wedge-shaped coupling section 31 arranged alongside it, are supported. The recess 53 is delimited at the top by edges 55 forming an anti-lift device 54, which extend beyond the top of the base section 30 and the top of the coupling section 31 and thus ensure that the coupling element cannot be lifted vertically from the operating surface.

When the side adjuster unit 26 is being mounted, the springy-elastic stop element 49 is pushed against the return force in the release direction. The coupling element 28 can be pushed under the edges 55 of the recess 53, wherein the threaded shaft 29 is screwed onto the adjusting wheel positioned in the holding receptacle 24. In this way, the coupling element 28 is moved towards the adjusting wheel. The threaded shaft 29 passes through the second side wall of the holding receptacle 24 and upon reaching the stop recess 51 the springy-elastic stop element clicks back into the engaged position.

When adjusting the side adjuster unit 26 the adjusting element 27 in the form of the adjusting wheel is moved in one or other direction. This leads to a lowering of the threaded section 29 and ultimately of the coupling section 31 coupled thereto in one or the opposite direction. If now the adjusting wheel is rotated so that the coupling element 28 moves away from the adjusting wheel, then the face of the springy-elastic stop element 49 after covering a certain travel, strikes the first face 52*a* of the stop recess. It is now no longer possible to turn the adjusting wheel further. Thus, the travel of the coupling element in this direction is limited. The threaded shaft 29 is thus prevented from being lowered from the adjusting wheel and dropping out of the holding receptacle 24. The travel is also limited in the opposite direction, because a surface of the base section 30 of the coupling element 28 strikes the second face 52*b*. There is no danger of the threaded shaft being unscrewed in this direction, however.

What is claimed is:

1. A device for releasably connecting a furniture pull-out to a guidance unit that movably guides the furniture pull-out in a furniture body, comprising:

a base part;

an adjuster arranged on the base part and enabling a position of the furniture pull-out to be set in at least one spatial direction relative to the guidance unit, the adjuster comprising a side adjuster unit to set a position of the furniture pull-out relative to the guidance unit transversely to a longitudinal direction of the guidance unit, the side adjuster unit comprising: an adjusting wheel and a coupling element moveable relative to the adjusting wheel, the coupling element including: a base section to couple with an associated section of the guidance unit; and a threaded shaft onto which the adjusting wheel is screwed; and a stop mechanism to delimit the travel of the adjuster, the stop mechanism including a springy-elastic component.

2. The device according to claim 1, wherein the stop mechanism comprises at least one springy-elastic, bolt-like stop element and a stop recess configured to hold the stop element and having faces that limit the travel of the adjuster.

3. The device according to claim 2, wherein the springy-elastic stop element is configured such that, between an engaged position in engagement with the stop recess and a released position for assembly/disassembly, the adjuster is moveable away from the base part, wherein the release position is reachable by working against a springy-elastic restoring force of the stop element.

4. The device according to claim 2, wherein the stop element is arranged on the adjuster and the stop recess is arranged on the base part.

5. The device according to claim 1, wherein the springy-elastic stop element is disposed on the base section of the coupling element and the stop recess is disposed on the base part.

6. The device according to claim 1, further comprising an anti-lift device to prevent lifting of the adjuster in a direction vertical to an operating surface of the device.

7. A piece of furniture, comprising:

a furniture pull-out that is movably guided relative to a furniture body via a guidance unit; and the device of claim 1.

* * * * *